United States Patent [19]

Miller

[11] Patent Number: 4,489,773

[45] Date of Patent: Dec. 25, 1984

[54] METHOD OF CASTING WITH POOL BOILING COOLING OF SUBSTRATE CASTING SURFACE

[75] Inventor: Russell S. Miller, Rexford, N.Y.

[73] Assignee: General Electric Company, Schenectady, N.Y.

[21] Appl. No.: 332,787

[22] Filed: Dec. 21, 1981

[51] Int. Cl.[3] ..... B22D 11/06; B22D 11/124

[52] U.S. Cl. ..... 164/463; 164/479; 164/485

[58] Field of Search ..... 164/463, 479, 480, 485, 164/423, 427, 428, 429, 443

[56] References Cited

U.S. PATENT DOCUMENTS 3,151,366 10/1964 Fromson ..... 164/485
3,845,810 11/1974 Gerding ..... 164/429
3,908,745 9/1975 Caldwell et al. ..... 164/463
3,915,219 10/1975 Mobley et al. ..... 164/485 X
4,307,771 12/1981 Draizen et al. ..... 164/463

OTHER PUBLICATIONS

*Marks' Standard Handbook for Mechanical Engineers*, Ed. by T. Baumeister et al., 1978, pp. 4–68, 69.

*Primary Examiner*—Nicholas P. Godici
*Assistant Examiner*—J. Reed Batten, Jr.
*Attorney, Agent, or Firm*—Bernard J. Lacomis; James C. Davis, Jr.

[57] ABSTRACT

A method for casting metal or metal alloy includes applying molten metal to a cool, rapidly moving, thermally conductive substrate so that the molten metal is rapidly cooled, and cooling the substrate by boiling a stagnant, with respect to the substrate, pool of coolant on a non-casting surface of the substrate.

13 Claims, 2 Drawing Figures

METHOD OF CASTING WITH POOL BOILING COOLING OF SUBSTRATE CASTING SURFACE

RELATED APPLICATIONS

Figure 1:
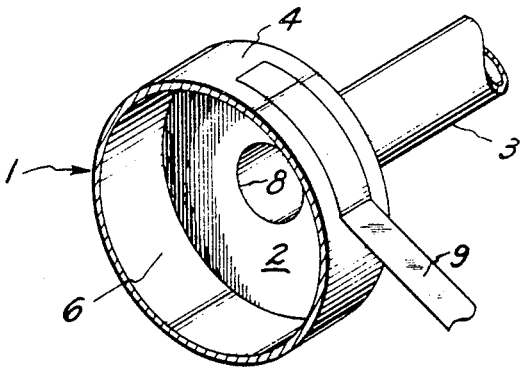

This application is related to R. S. Miller's application Ser. No. 332,788 filed Dec. 21, 1981, and assigned to the instant assignee.

BACKGROUND OF THE INVENTION

The usual method of preparing metal and metal alloy ribbons and the like is a chill block melt spinning method. In this procedure, the molten metal or an alloy thereof is applied to a cool, rapidly moving, thermally conductive substrate, the molten metal is rapidly cooled to below its solidification point and is then flung or forcibly removed from the substrate. The apparatus commonly used in performing this method are spinning wheels and discs in combination with either free jet or planar casting melt delivery systems. The resulting product is usually a straight or helical ribbon, tape or film of about 1 to about 2 mils in thickness. Other methods which have been used for the production of such cast metal or metal alloys include the drawing of thin filaments into a cooling medium or the generation of small diameter splats or particles.

The continuous casting of metal and alloy ribbons requires that heat be removed from the thermally conductive substrate so that it can function as a heat transfer surface or the metal or metal alloy being cast. Various single roll and double roll methods have been developed but can be operated for only extremely short periods of time if no cooling is provided. The heat can be removed from the casting substrate, either from the casting surface or from any other convenient surface of the substrate. It is necessary that the heat removal from the casting substrate be accomplished with a heat transfer coefficient sufficient to maintain the casting surface temperature below the metal or metal alloy solidification temperature. For example, cooling a molten metal rapidly ($10^5$–$10^6$° F./sec.) on a 10-inch copper wheel rotating at 1500 r.p.m. (65.4 ft./sec. tangential velocity or about 321 g's angular acceleration) gives rise to a heat flux associated with the solidification which is estimated to be about $2\times10^6$ BTU/hr. ft$^2$. A 40-inch diameter copper-chrome cylinder of about ½ inch in thickness which rotates at 400 r.p.m. (70 ft./sec. tangential velocity or about 91 g's angular acceleration) can be subjected to an average heat flux of 370,000 BTU/hr. ft$^2$. In these examples heat transfer coefficients of 30,000 and 5,000 BTU/hr.−ft$^2$−° F. would typically be desired.

If the casting of the metal or metal alloy is performed under vacuum conditions, a procedure is necessary to steadily remove heat from the non-casting surface of the rapidly moving, thermally conductive substrate such as, for example, the interior of a casting wheel. Single phase forced convection has frequently been employed for cooling non-casting surfaces, such as the interior surface of a casting wheel, but this method is characterized by high volume flow rates, axial variations in heat transfer and flow maldistribution. It also requires expensive machining of the heat transfer substrate. The continuous dressing of the casting surface and the occasional machining which may also be required results in substrate thicknesses which vary over time. As a result, the cooling method which is used to maintain constant casting surface temperatures must be adequate to compensate for the varying heat transfer substrate thicknesses and must also have axially invariant heat transfer coefficients and not require elaborate machining.

Pool boiling has commonly been applied to the cooling of stationary heat sources such as nuclear and chemical reactors and power electronics, and more recently to rotating equipment. Rotating boilers seek to use higher critical heat flux (CHF) limits which are associated with the radial acceleration to reduce boiler size and to exploit an as yet unproven improvement in heat transfer coefficient. Rotating heat pipes generally utilize the acceleration as a substitute for a wick, and improve heat transfer coefficients by maintaining thin fluid layers in the evaporator and condenser sections.

It is an object of this invention to provide a method for the cooling of amorphous metal and metal alloy casting substrates, such as wheels, which is operative on the non-casting surfaces, such as the inside of casting wheels, and which has uniform axial heat transfer coefficients.

It is also an object of this invention to provide a cooling method which does not require complicated machining of the casting substrate and which can be used, if desired, to vary the casting surface temperature.

A further object of this invention is to provide a boiling heat transfer method which uses a rotating system to advantage in increasing critical heat flux limits.

Figure 2:
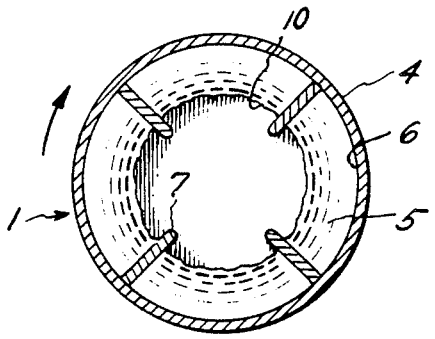

These and other objects of the invention will become apparent to those skilled in the art from the following detailed description in which:

FIG. 1 is a plan view of a rotating circular hollow cylinder to which the present invention can be applied, and FIG. 2 is a cross-section of a rotating circular hollow cylinder in accordance with the present invention.

SUMMARY OF THE INVENTION

This invention relates to a method for casting metal and/or metal alloys on a rapidly moving thermally conductive substrate, such as a casting wheel, and more particularly to the provision of a method of cooling the casting surface of such substrate, the exterior surface in the case of a casting wheel, by establishing a layer or pool of liquid coolant in contact with a non-casting surface of the casting substrate, for example, the interior surface of a casting wheel. This layer will be stagnant with respect to the substrate and coolant boiling will be established or effected at the surface of the coolant layer which is in contact with the non-casting surface of the substrate.

DESCRIPTION OF THE INVENTION

One type of a rapidly moving, thermal conductive substrate is shown in FIG. 1 and comprises a rapidly rotatable casting wheel. It will be appreciated that other types of casting substrates such, as rotatable discs, can also be employed.

The casting wheel of FIG. 1 takes the form of a hollow cylinder 1. The hollow cylinder 1 is shown with one end thereof being capped by a flange 2. An appropriate drive shaft 3 is connected to hollow cylinder 1 through flange 2 and can be driven by suitable driving apparatus which is not shown. When in use, the other end of hollow cylinder 1 will also be capped with an appropriate flange which may or may not carry an additional drive shaft 3, as desired.

A melt of metal or metal alloy is prepared in the conventional manner. The molten metal or metal alloy is then deposited on the casting surface, which in the case of FIG. 1 is the exterior surface 4 of hollow cylinder 1, through any suitable conventional depositing means such as an injection nozzle (not shown). The exterior surface 4 of hollow cylinder 1 is maintained at a temperature below the solidification point of the molten metal or metal alloy. Heat is transferred from the melt to the casting wheel and the resulting decrease in temperature of the melt from this heat transfer causes the melt to solidify into the form of a cast ribbon or film 9. The deposited metal or metal alloy travels with the rotating exterior surface 4 of hollow cylinder 1 for a time sufficient to permit the desired degree of solidification to take place, and then is stripped or flung from hollow cylinder 1 and recovered in the conventional fashion.

As best shown in FIG. 2, in accordance with the present invention, a quantity of a liquid coolant is supplied to the interior of hollow cylinder 1 in such a manner as to form an annular coolant layer 5 on the interior wall 6 of hollow cylinder 1. Water is the preferred coolant but other liquid coolants can also be used. The depth of coolant layer 5 is controlled by regulating the amount of coolant introduced to interior surface 6 and the rate of coolant removal therefrom. As a result of the high angular acceleration of the rotating hollow cylinder 1, the hydrostatic pressures at the inside wall 6 can substantially raise the saturation temperature. In typical applications, the centrifugal forces are many times greater than gravity, thus causing the annular coolant layer 5 to be nearly concentric with cylinder 1. In situations where significant deviations may occur from the uniform coolant depth, one or more stationary vanes 7 can be affixed to interior wall 6 of hollow cylinder 1 in order to aid in causing the coolant to be stagnant with respect to interior surface 6. Typically, these vanes may be readily oriented.

As shown in FIG. 1, drive shaft 3 can be hollow and flange 2 provided with an aperture 8 so as to provide a conduit for coolant introduction and removal, and for removal of coolant vapors.

The exterior surface 4 and interior surface 6 of hollow cylinder 1, and the coolant layer 5, are in heat transfer contact. Heat is transferred from the molten metal or metal alloy to the exterior surface 4 and then to the interior surface 6 of hollow cylinder 1, and finally into the coolant layer 5. As a result, a quantity of the coolant is caused to boil at the interior surface 6 or interface with coolant layer 5.

The temperature of the exterior casting surface 4 can be controlled by regulating the depth of the coolant layer 5 and by adjusting the pressure at the surface 10 of coolant layer 5. The optimum combination of pressure and depth can be easily established by a few simple experiments. For example, and not by way of limitation, a 40-inch diameter copper chrome cylinder of ½-inch thickness which rotates at 400 r.p.m. (70 ft/s tangential velocity or about 91 g's angular acceleration) can be subject to an average heat flux of 370,000 B.T.U./hr-ft$^2$. The casting surface can be controlled to any temperature within the range of 285° F. and 400° F. by establishing and maintaining a water layer 5 on interior surface 6 of 1 to 10 inches in depth and a pressure at the surface 10 of the water 5 between 0.95 and 35 p.s.i.a. The relative contribution to the control of the desired temperature will depend on the order in which the water depth and pressure are established. In this example, if the water depth is established before the pressure is regulated, each factor will contribute about one-half of the control. If the pressure is first established and then the water depth is achieved, the water depth will contribute only about one-quarter of the control. By regulating the pressure within a range of about 0.95 to 35 p.s.i.a. and the water depth within a range of about 1 to 10 inches, it is possible to compensate for variations between individual hollow cylinder 1 wall thicknesses of between about one-half inch and one inch while maintaining a constant casting surface temperature of, for example, 400° F.

Of course, pressures greater than 35 p.s.i.a. are readily obtainable and may be used. Also, cylinders having a diameter less than 40 inches, say about 10 inches, may be used and have the added advantage of being generally easier to fabricate.

The contribute of the water depth to control of the casting surface temperature can be duplicated by increasing the pressure at the surface 10 of the coolant layer but it may be advantageous to maintain the exterior system pressures as low as possible or to maintain atmospheric pressure conditions exterior to hollow cylinder 1.

To take advantage of increased CHF limits due to acceleration, the acceleration of the substrate must be substantially normal to the non-casting surface and thus is geometrically dependent. However, the CHF limits are also increased by the increasing pressure which results from the increase in hydrostatic head due to acceleration. This effect is not dependent on the orientation of the boiling surface.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. A method for casting metal or metal alloy on a rapidly moving surface comprising: depositing a layer of molten metal or metal alloy on a casting surface of a rapidly moving thermally conductive substrate and thereafter removing the resulting casting of said metal or metal alloy therefrom, wherein said casting surface is cooled to a temperature below the solidification point of said metal or metal alloy by contacting a layer of coolant to an accelerating non-casting surface of said substrate wherein acceleration of said non-casting surface is substantially normal to the non-casting surface, said layer of coolant moving at about the same speed as said non-casting surface so as to be relatively stagnant with respect thereto, and effecting boiling at the interface of said layer of coolant with said non-casting surface.

2. The method of claim 1 including the step of regulating the boiling by regulating the depth of said layer of coolant.

3. The method of claim 1, including the step of regulating the boiling by regulating the pressure at the surface of said layer of coolant.

4. The method of claim 1 including the step of regulating the boiling by regulating the angular acceleration of said substrate.

5. The method of claim 4 wherein said substrate comprises a hollow cylinder.

6. The method of claim 5 wherein the non-casting surface of said cylinder includes a plurality of vanes adapted to assist in maintaining said layer of coolant relatively stagnant with respect to the non-casting surface.

7. The method of claim 5 wherein said coolant comprises water.

8. The method of claim 7 wherein the depth of said water layer is about 1–10 inches and pressure at the surface of said water layer is maintained between about 0.95 and 35 p.s.i.a.

9. The method of claim 1 wherein said casting surface is maintained at a temperature of 285°–400° F.

10. The method as in claim 5 wherein the angular acceleration of said cylinder is less than about three hundred twenty one times acceleration due to gravity.

11. The method as in claim 5 wherein the angular acceleration of said cylinder is greater than about ninety one times acceleration due to gravity.

12. The method as in claim 1 wherein the angular acceleration of said cylinder is greater than about ninety one and less than about three hundred twenty one times acceleration due to gravity.

13. The method as in claim 5 wherein the angular acceleration of said layer of coolant is sufficient to overcome gravitational forces acting on said layer of coolant.

* * * * *